US006429765B1

(12) United States Patent
Valdemarsson et al.

(10) Patent No.: US 6,429,765 B1
(45) **Date of Patent: *Aug. 6, 2002**

(54) CONTROLLABLE INDUCTOR

(75) Inventors: Stefan Valdemarsson; Lars Liljestrand, both of Västerås; Erik Forsberg, Smedjebacken; Sören Petersson, Ludvika, all of (SE)

(73) Assignee: ABB AB, Vasteras (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/180,567

(22) PCT Filed: May 16, 1997

(86) PCT No.: PCT/SE97/00803

§ 371 (c)(1),
(2), (4) Date: Nov. 10, 1998

(87) PCT Pub. No.: WO97/44796

PCT Pub. Date: Nov. 27, 1997

(30) Foreign Application Priority Data

May 23, 1996 (SE) ..... 9601949

(51) Int. Cl.[7] ..... H01F 27/24
(52) U.S. Cl. ..... 336/212
(58) Field of Search ..... 336/212, 55, 59, 336/60, 234, 207, 223

(56) References Cited

U.S. PATENT DOCUMENTS

| | | | | | |
|---|---|---|---|---|---|
| 3,577,109 | A | * | 5/1971 | Foster et al. | 336/212 |
| 3,579,163 | A | * | 5/1971 | Cronin | 336/94 |
| 3,815,068 | A | * | 6/1974 | Hori et al. | 336/100 |
| 4,092,607 | A | * | 5/1978 | Robins | 336/195 |
| 4,210,859 | A | * | 7/1980 | Meretsky et al. | 323/44 R |
| 4,853,565 | A | * | 8/1989 | Elton et al. | 310/45 |
| 5,900,795 | A | * | 5/1999 | Holmgren et al. | 336/55 |
| 5,929,737 | A | * | 7/1999 | Zinders et al. | 336/155 |

FOREIGN PATENT DOCUMENTS

| | | |
|---|---|---|
| RU | 678 542 | 8/1979 |
| WO | WO 94/11891 | 4/1994 |

* cited by examiner

*Primary Examiner*—Lincoln Donovan
*Assistant Examiner*—Tuyen T. Nguyen
(74) *Attorney, Agent, or Firm*—Connolly Bove Lodge & Hutz LLP

(57) ABSTRACT

A controllable inductor comprises at least a tubular core, a main winding surrounding the core and a control winding passing substantially axially through the core. A yoke of a material having a high magnetic permeability is arranged to extend outside the core and the main winding and together with the core form a closed loop having at the most small air gaps for a main magnetic flux generated in the core by a current in the main winding and extending substantially axially to the core. The control winding comprises first plates of a material having a good electric conductivity extending substantially axially through the core.

17 Claims, 6 Drawing Sheets

CONTROLLABLE INDUCTOR

FIELD OF THE INVENTION

The present invention relates to a controllable inductor comprising at least a tubular core, a main winding surrounding the core and a control winding passing substantially axially through the core.

Such controllable inductors may through the main winding thereof be connected to any electrical circuit, such as an electric power line, so as to provide this circuit with an inductance, for example for extinguishing harmonic currents generated in the circuit. The magnetic permeability of the core and by that inductance of the inductor may then be controlled by modifying an electric control current caused to flow axially through the core in the control winding. By connecting such a controllable inductor in series with a capacitor a so called harmonic filter is obtained, which is already known, for example as described in WO 94/11891 of the applicant and in which the impedance may be controlled to be low for certain frequencies by controlling the inductance of the inductor for fading out harmonic currents having a frequency being a multiple, for example 11, of the fundamental frequency of the network.

Usually an alternating voltage is connected to the main winding, but it would also be possible to connect a direct voltage with an overlapped alternating voltage to the main winding, but in that case the inductor would only have a useful influence upon the alternating voltage part. The control current brought to flow through the control winding is normally a direct current, but it would just as a well be possible to use an alternating current as control current and by controlling such an alternating current control current appropriately even voltage induced in the control winding, which causes harmonic currents in the main winding and losses in the core, may be eliminated.

In controllable inductors already known the main magnetic flux extending substantially axially through the core is closed in the air outside the core and the main winding, so that a so called air reactor is formed. A disadvantage of such an inductor is that it allows a regulation of the inductance within a comparatively narrow interval, most often only by a factor of about 10%. This narrow regulation interval of the inductance of such an inductor greatly limits its field of use, and it may therefore mainly be used as an harmonic filter.

Also other controllable inductors not having any control winding are known, but these may in principle be regarded as fixed, but through intermittently connecting different such inductors to the circuit in question it is possible to provide it with a controllable inductance. In such fixed inductors functioning according to this principle the harmonic or overtone generation will be great with considerable disadvantages resulting therefrom, primarily the need of several filter banks so as to eliminate harmonics generated. Additionally, these inductors have to be controlled by thyristors to be water-cooled and by that controlled through an expensive control equipment.

SUMMARY OF THE INVENTION

The object of the present invention is to provide a controllable inductor of the type defined in the introduction, which has a simple construction and by that is inexpensive therefore, the function thereof is reliable and this makes it possible to regulate the inductance within a comparatively wide range for broadening the field of use of such a controllable inductor with respect to the already known inductors discussed above.

This object is according to the invention obtained by providing such a controllable inductor with a yoke of a material having a high magnetic permeability arranged to extend outside the core and the main winding and together with the core form a close loop having at the most small air gaps for a main magnetic flux generated in the core by a current in the main winding and extending substantially axially in the core. The control winding comprises first plates extending substantially axially through the core and being of a material having a good electric conductivity.

Due to the fact that the control winding comprises the first plates it is possible to obtain a control winding at a low cost and most importantly a stable mechanical construction of the inductor. This makes it possible to conduct the control winding in a path outside the main winding, by which it is possible to arrange a yoke closing the main magnetic flux through the core with at the most small air gaps in the loop provided for the main magnetic flux. The controllability its is very high in such an inductor having at the most small air gaps, since the main part of the energy stored will be within material having a low magnetic permeability, contrary to a so called air reactor in which a great part of the energy is stored in the air and, by that, it may not be regulated as easily. In an inductor of the type according to the invention, regulation of the inductance is made possible to a considerably greater extent than in known inductors, such as easily by a factor 5 or more. "Small air gaps" are defined as air gaps being small with respect to the thickness of the wall of the core, so that eddy current losses may be avoided. It would be possible to arrange many small distributed air gaps in the core, when no particularly great controllability of the inductance of the inductor is needed, since in this way iron may be saved and the entire inductor could be less costly. However, the greatest controllability is obtained when the air gap is at a minimum.

A possible field of use for an inductor of this type is a switching in alternating voltage power lines, which have a high capacitance built-in therein, for example cable networks. By an intermediate connection of the inductor an inductance of a desired size may be added and by that the reactance of the power line may be reduced for a more efficient energy transfer through the line.

According to a preferred embodiment of the invention the control winding also comprises second plates extending outside the core and the main winding and being of a material having a good electric conductivity. The plates are electrically connected to the first plates and adapted to together therewith form closed loops for a current flow in the first plates through the core. By such a construction of the control winding a very stable mechanical construction, is achieved so that the function thereof will be constant over time and the device is reliable, and it also becomes simple and cheap to manufacture.

According to another preferred embodiment of the invention, the first plates are arranged in different packages of plates pressed together with large flat surfaces thereof against each other. The packages have one or more plates, and these plate packages have substantially the same cross section. Plates having one thickness may be used for obtaining electric conductors, which are constituted by the plate packages, for the control current through the core having substantially the same cross section, so that substantially just as much heat loss is generated in each conductor and there will be no problem with local superheating.

According to a further development of the embodiment last mentioned, the plate packages have a thickness reduced in the direction of a radius of the core perpendicularly to the large flat surfaces of the first plates towards the centre of the core for obtaining a maximum filling of the inner hollow space of the core. By such a design of the control winding, i.e. a reduction of the thickness of the control plates where these may be made wider in the direction of their large flat surfaces thereof in parallel with a radius of the core, a maximum filling of the inner hollow space of the core and by that a good controllability of the inductor may be obtained.

According to another preferred embodiment of the invention the yoke comprises plates arranged to extend substantially in parallel with each other at each end of the core and being with their large surfaces thereof in parallel with a plane defined by a radius of the core and the axis of the core. The yoke plates have an edge thereof located in the immediate vicinity of the respective core end so as to receive the main magnetic flux from the core without any substantial air gap therebetween. The second control plates are arranged in a space between yoke plates arranged side by side and have substantially the same direction in the room as the yoke plates, so the yoke plates and these control plates form a sandwich construction. This embodiment is very advantageous, since yoke plates extending substantially in parallel with each other without any real disturbance of the second control plates included in the control winding may be brought to cover substantially the entire area through which the main magnetic flux may be expected to cover. Thus no cross flux plates are needed and a cross magnetization of the yoke and eddy current losses caused thereby is avoided. Because the said plates of the control winding are of a material having a low magnetic permeability, i.e. having a high reluctance, the reluctance perpendicular to the yoke plates may in this way be made high, so that the control flux is prevented from going out of the core and into the yoke at the ends of the core. A control flux in the yoke would impair its permeability and result in increased losses.

According to a further preferred embodiment of the invention the second control plates are arranged with their large flat surfaces substantially in parallel with the large flat surfaces of the first control plate, and at least a first control plate of each control plate package is arranged to protrude from the core past the edge of the respective second control plate located closest to the core so as to enter into electric contact establishing bearing thereagainst. A stable closed loop of the control winding may in this way be easily formed.

According to another preferred embodiment of the invention the inductor is intended to be connected to a three-phase alternating current network and it has one core and one main winding for connection to each phase. Such an inductor is particularly advantageous since the voltages induced in the control windings through the alternating main magnetic flux will cancel each other out, so that a generation of harmonics in the network and losses in the core are avoided.

According to another preferred embodiment of the invention the inductor has, for connection to a multiphase alternating-current network, a yoke in common to and closing the main magnetic flux through all the cores and forming main magnetic flux paths between all cores. This is important for keeping the main magnetic flux within the parts having a high magnetic permeability (yoke and core), since the main magnetic flux flowing through a core has to be able to be distributed on the other cores and the sum of the main magnetic flux has in each moment to be zero.

According to another preferred embodiment of the invention the control winding of each core is electrically connected to a control winding for the adjacent core through the second control plates and the control winding of the two cores located outermost is through the control plates also electrically connected to one outer leg each of third control plates, which like the first control plates connect second control plates on one end of the cores to second control plates on the other end of the cores. By arranging such an outer leg with three control plates it may easily be accomplished that a control current is running through all first control plates in all the cores.

BRIEF DESCRIPTION OF THE DRAWINGS

With reference to the appended drawings, below follows a description of preferred embodiments of the invention cited as examples.

In the drawings.

DETAILED DESCRIPTION OF PREFERRED EMBODIMENTS OF THE INVENTION

Figure 1:
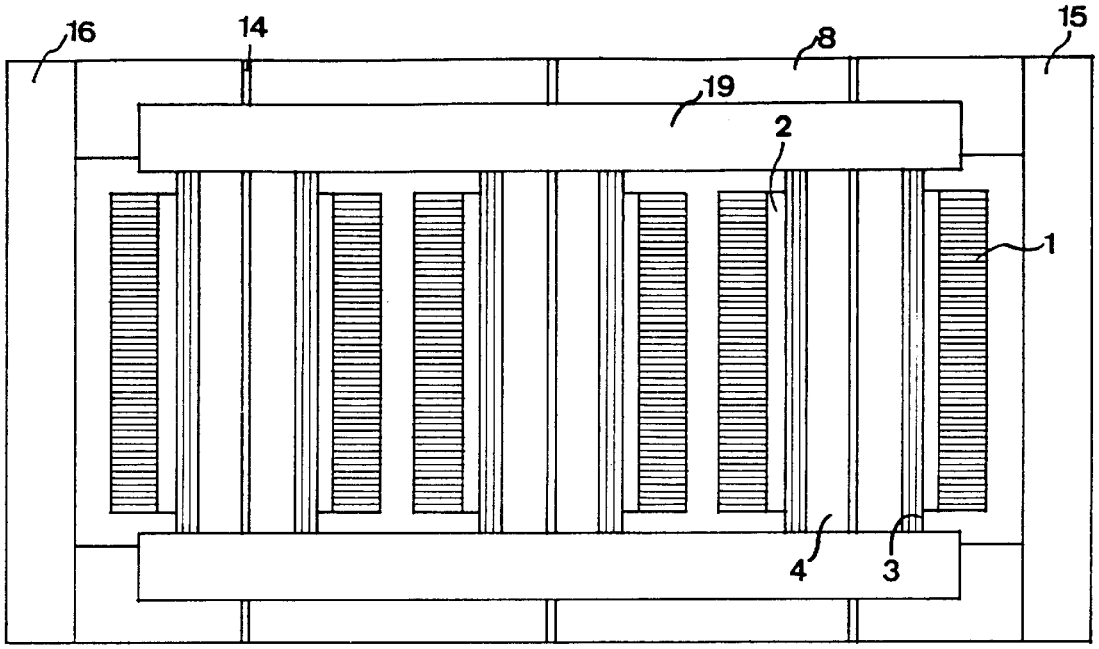
FIG. 1 is a simplified, partially sectioned side view of a controllable inductor intended to be connected to a three-phase alternating-current network according to a first preferred embodiment of the invention.
Figure 2:
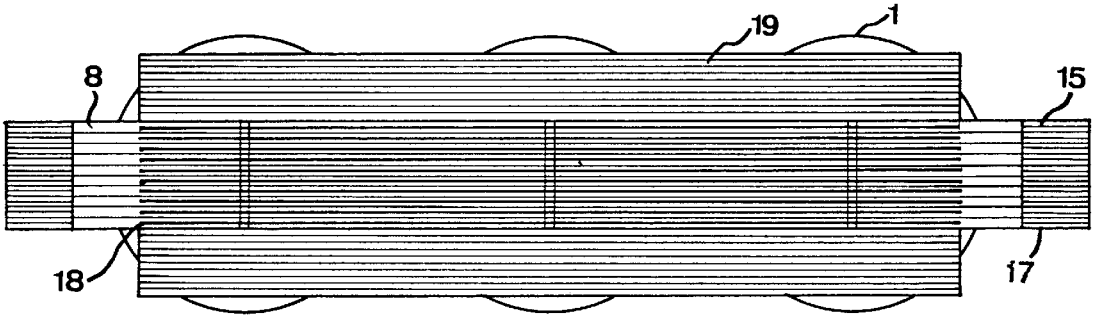
FIG. 2 is a simplified view from above of the inductor according to FIG. 1.

The inductor schematically illustrated in FIG. 1, the construction of which will now be explained while at the same time referring to FIG. 2, is adapted to be connected to a three-phase alternating-current network and has three main windings 1 schematically indicated, each of which is wound in layers at a distance outside a carrier, not shown, such as a cylinder of electrically insulating material. Each such main winding is connected to one phase of their own of the alternating-current network and has an upper end connected to high potential, wherein the voltage is falling in the direction towards the opposite end, being the lower one in FIG. 1, which is on ground potential, but it could just as well be on potential. Inside and co-axially to the respective main winding and with an interval 2 with respect thereto a core 3 of a material having a high magnetic permeability, such as iron, is arranged. A control winding 4, which is formed by a plurality of separate part control windings and is built in a way to be explained further below, passes substantially axially through the respective core. This control winding runs in loops in a way explained below.

The control winding 4 is connected to a voltage, which most often would be a direct current voltage, but an alternating voltage is also conceivable, and this voltage gives rise to a current in the control winding. The alternating current in the main winding generates a main magnetic flux, which passes substantially axially through the core, while the control current in the control winding 4 will generate a magnetic flux directed tangentially and transversally to the main flow and in this way reduce the permeability thereof for the longitudinal magnetic flux from the main winding. By increasing the current in the control winding 4 the permeability of the core may be reduced and by that the inductance of the inductor may be reduced. This is the main principle according to which a controllable inductor of this type functions. This principle is already known, and the special thing with the invention is how the inductor is constructed so as to make this controllability possible, and this will now be explained while referring to the drawing figures enclosed.

It is first of all appropriate to mention the power generation per volume unit as a consequence of a magnetic flux passing transversally to surfaces of a metallic object is proportional to the square of the thickness of the object measured perpendicularly to the flow direction. This is the reason for the production of the core 3 with very thin plates wound through a plurality of turns, which however does not appear from the figure. By way of example it may here also be mentioned that the control current typically may be a direct current in the region of 100–500 A, while the high potential end of the main windings may be connected to a voltage of 400 kV. A controllable inductor of this type with such high direct currents easily results in a problem to achieve controlling of the magnetic flux in the cores and not at another place through the direct current. How this is solved will be explained below.

Figure 4:
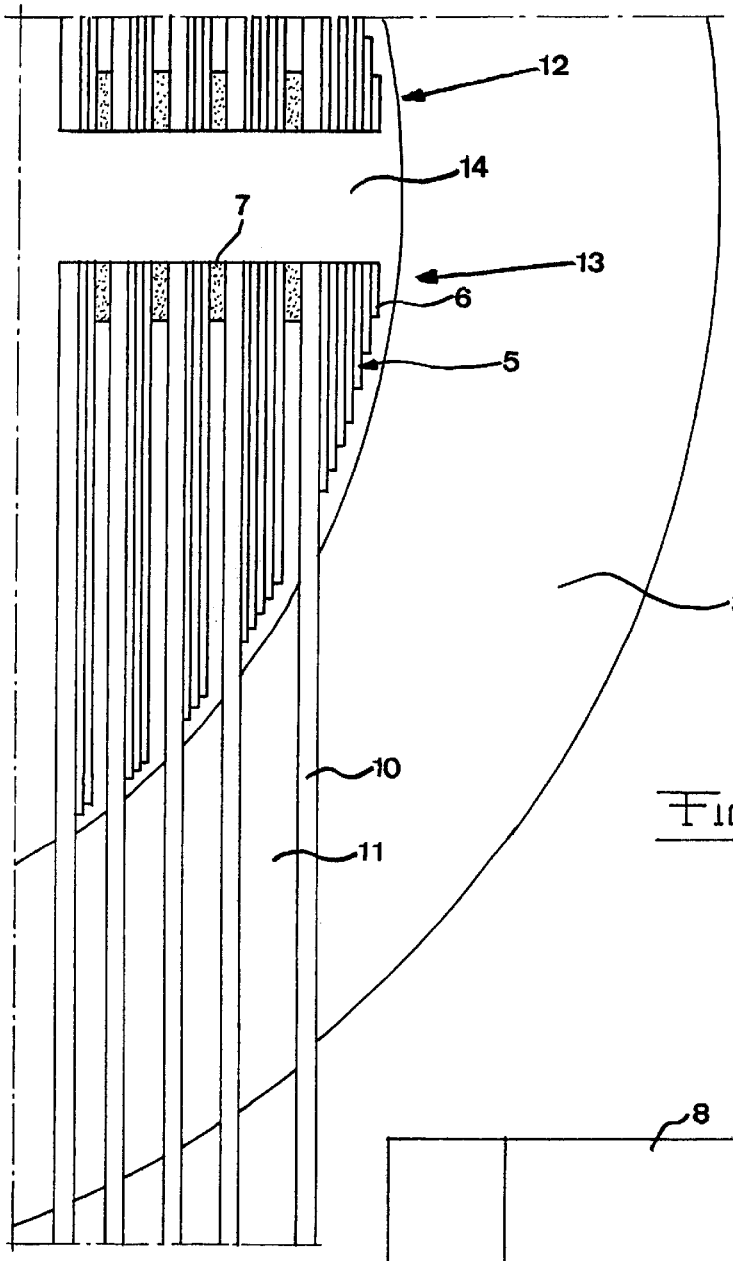
FIG. 4 is a view from above of a part of the inductor according to FIG. 1 and 2, said yoke having been omitted for the sake of illustration.

The control winding 4 comprises first plates of material having a good electric conductivity, preferably copper, which are divided into several packages 5, which each is formed by a number of thin plates 6 pressed in electric contact against each other by means of their large flat surfaces, such as illustrated in FIG. 4. These first plates extend substantially axially through the respective core and they are arranged with their large flat surfaces substantially in parallel with each other and each package is electrically insulated from adjacent packages and the core 3 through suitable spacer pieces 7 of a material being electrically insulating. The plate packages 6 have in their extension inside the core 3 substantially the same cross section, since they have to conduct a control current of the same magnitude and this results in the heat production in the respective packages being nearly the same, so that the cooling need for each package may be assured. The same current density in the plate packages results in the best utilizing of the material, so that a small amount material as possible may be used and costs may be kept low. It is illustrated in FIG. 4 how the different plate packages 5 have a thickness decreasing towards the center of the core in the direction of a radius of the core perpendicularly to the large flat surfaces of the first plates for obtaining a maximum filling of the inner cavity of the core, and in this way a filling factor in the order of 60% of the inner cavity of the core may be obtained.

Figure 6:
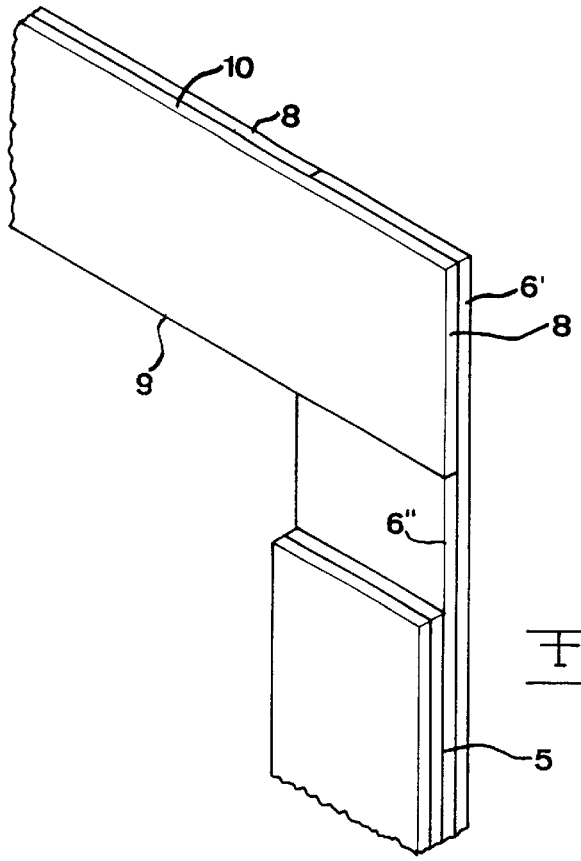
FIG. 6 is a simplified view illustrating how first and second control plates are connected to each other in the inductor according to FIG. 1.

It is schematically illustrated in FIG. 6 how a control plate package 6 extending through a core is connected to second plates 8 being part of the control winding, which are also of material having a good electric conductivity and preferably is formed by similar plates with respect to the material and possibly also the thickness of the first control plates. The second control plates 8 extend outside the core and the main winding substantially perpendicularly to the axis of the core and with their large flat surfaces thereof substantially in parallel with their large flat surfaces of the first control plates 6. At least one of the first control plates 6' is arranged to project from the core past the edge 9 located closest to the core of the respective second control plate so as to enter into bearing thereagainst establishing an electric contact. It is pointed out that it has in FIG. 6 for simplifying purposes been illustrated how the control plate package 5 in the core only has four plates and two plates 6' and 6" project out from the core, but in practice each element shown as a plate in that figure would be formed by a number of plates laid against each other. Thus, the second plates 8 may also be arranged in packages 10, such as illustrated in FIG. 6 by arranging two such plates against each other there. It is illustrated through FIG. 6 that the thickness of the package 10 of second plates is less than the thickness of the package 5 of first control plates, which is necessary for creating a space 11 (see FIG. 4) between adjacent packages 10 of second control plates for a reason to be described further below. It is then fully possible that the cross section of the package of second control plates is smaller than the cross section of the package 5 of first control plates. Since a higher heat release as a consequence of the control current may be accepted in those portions of the control winding which are located outside the core than in those inside the core, second controls plates may be more easily cooled. In order to be able to conduct the control current further from those control plates 6 (in FIG. 6 two such ones) in the package 5 not extending through the package 10 a welding seam not shown is applied on the upper edge thereof and over to the plate 6 for conducting the current over thereto.

It is illustrated in FIG. 4 how the packages 5 of the first control plates are arranged in two groups 12, 13 which are separated from each other by a space 14 extending transversally to the large flat surfaces thereof. This space is arranged so as to offer good cooling of the control winding by passing a cooling medium, such as oil, air or the like, therethrough (see also the middle arrow in FIG. 5). The respective package 10 of second control plates is at the respective end thereof only connected to first control plates belonging to one of the two groups and extends there only to space 14. The control winding of each core is in this way arranged through the packages 10 of second plates 8 electrically connected to a control winding for the adjacent core, i.e. the packages of first plates 6 running through that core, and the control winding of the two cores located outermost are through package 10 also electrically connected to an outer leg 15, 16 (see FIG. 1) each of third control plates 17, which extend in a corresponding way as the first control plates and connect second control plates at one end of the cores to second control plates at the other end of the cores. The third control plates are also arranged in packages consisting of one or several thin plates, which are electrically insulated from each other, the number of such packages being just as high as the number of packages of second control plates.

The different packages of first, second and third control plates are so connected to each other that a current path (see FIG. 7) is formed from a first 15 of the outer legs, at which the control winding is connected to a control voltage, to the first control plates of the core located closest thereto and back to the outer leg so many times that all the first control plates of one control plate group 12 of this core has been passed, then further to the adjacent second core for running through a loop through the first control plates of this core and the first control plates of the adjacent third core so many times that all the first control plates of one control plate group of the second and third cores have been passed, and so on until the second outer leg 16 is reached and then back to the first outer leg while running through all the first control plates of the second control plate group 13 of the respective core. The permeability of all the three cores and by that the inductance of the inductor may by that be controlled by simple means through one single connection to a control voltage source.

Figure 3:
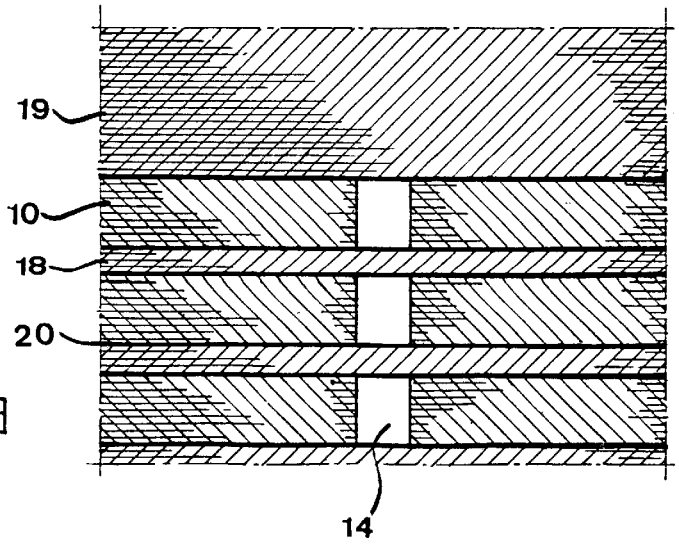
FIG. 3 is an enlarged partially schematic view from above illustrating the arrangement of yoke and control winding through a sandwich construction over one of the cores of the inductor according to FIG. 1 and 2.

Yoke plates 18 or packages of such yoke plates are arranged in the space 11 between adjacent control plate packages 10, the yoke plates are of a material having a high magnetic permeability, preferably iron, and extend from one outer core to the other outer core. The yoke plates and the control plate packages 10 form then a sandwich construction, such as illustrated in FIG. 3. Accordingly, the spaces 11 are provided so as to enable arrangement of such yoke plates therein, these yoke plates being omitted in FIG. 4. The yoke 20 plates 18 are also arranged in the direction perpendicularly to the large flat surfaces of the plates outside the second control plates of the packages, such as illustrated in FIG. 2, and the yoke plates 19 located there are arranged without any space therebetween. The yoke plates are by that arranged to cover at least substantially the entire cross section of the core and the space 2 between the core and the main winding. This definition is intended to comprise the case illustrated that the yoke plates are arranged with a certain space therebetween, where the packages 10 of second control plates are located. It is then in practice possible to have another relation between the thickness of the yoke plates 18 and the packages 10 of second control plates different from what is illustrated in FIG. 3. An insulating layer 20 is arranged between the yoke plates 18 and adjacent control plate packages 10.

Figure 5:
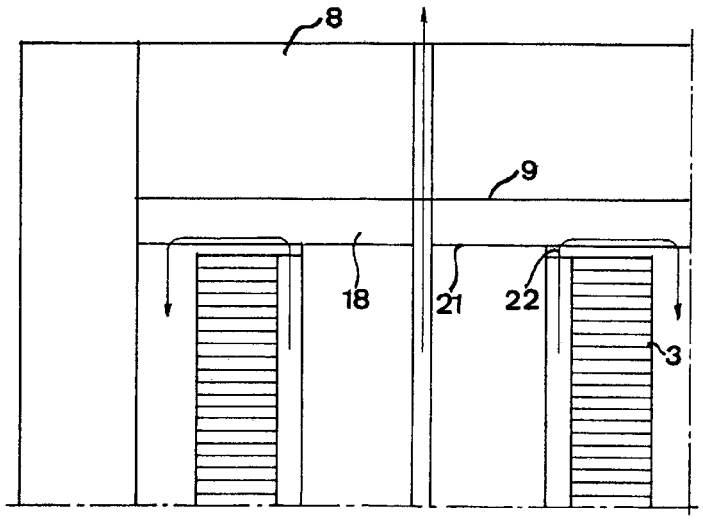
FIG. 5 is a simplified vertical section slightly enlarged with respect to FIG. 1 through a core of the inductor according to FIG. 1.

It is illustrated in FIG. 5 how the second control plates 8 are arranged to have the edge 9 thereof located closest to the respective core end at a distance from this core for allowing a passage of a cooling medium, such as air, oil or the like, from the interior of the core and radially outwardly therefrom at the core end, as is indicated through the arrows, while the yoke plates 18 extend by the edge 21 thereof located closest to the core 3 at a very small distance from the core 3 for obtaining a minimum air gap 22 therebetween.

The different cores are magnetically connected to each other through the yoke plates 18, 19, and the longitudinal main magnetic flux formed in the respective core 3 may be closed through these yoke plates and the other cores included in the inductor in a substantially air gap free way, so that the main part of the energy in the inductor will be stored within this "iron", so that the inductance of the inductor may be controlled within a wide range, which easily may mean a controllability by a factor 5. The main magnetic flux lines coming out of the respective core 3 directly under a package of second plates 10 have to be slightly bent for entering the yoke plate located closest thereto, which results in a certain concentration of flux lines there, which however is a small problem. Due to the fact that the packages 10 of second control plates, which have a high reluctance, are arranged between yoke plates where such packages 10 are present, the cross control magnetic flux running in the core is efficiently prevented from going up into the yoke plates extending more or less transversally thereto and then downwardly into the core again, so that it is efficiently avoided that the control flux magnetizes the yoke plates and by that deteriorates the permeability thereof.

The yoke plates 18, 19 cover, except for the entire respective core, also a space 2 between the main winding and the core for absorbing leakage flux present there.

The main advantages of an inductor according to FIG. 1 are the following:

1. No cross flux plates are required for absorbing the magnetic flux from the entire respective core and the space located between the core and the main winding, which results in an inexpensive construction.
2. No cross magnetization of the yoke through the control current takes place, which would procure hysteresis losses and eddy current losses in the yoke.
3. The control winding may be produced at a low cost, and it is here emphasized that, although it is discussed about winding, it is a question of comparatively stiff bodies as far as the control plate packages are concerned.
4. The construction will be very stable.
5. The voltages in the control winding induced by the main voltage in the main winding cancel each other out in an inductor of this type connected to a three-phase alternating-current network.

Figure 7:
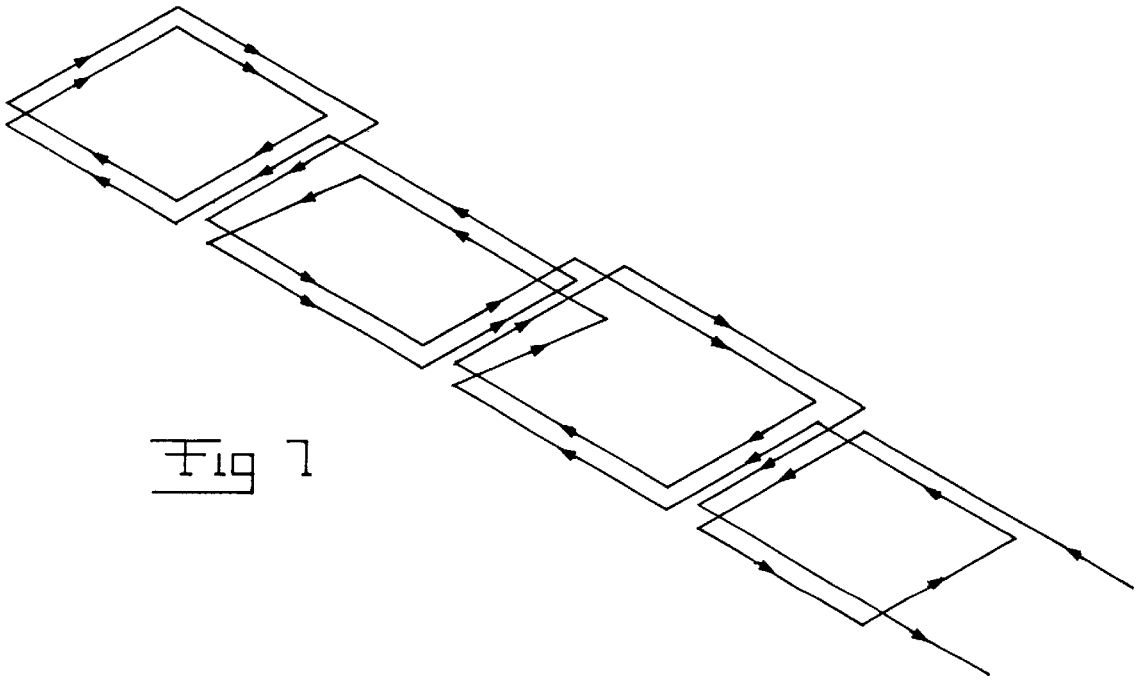
FIG. 7 is a view illustrating how control plates of the inductor according to FIG. 1 are connected to each other for obtaining the control current path illustrated.
Figure 8:
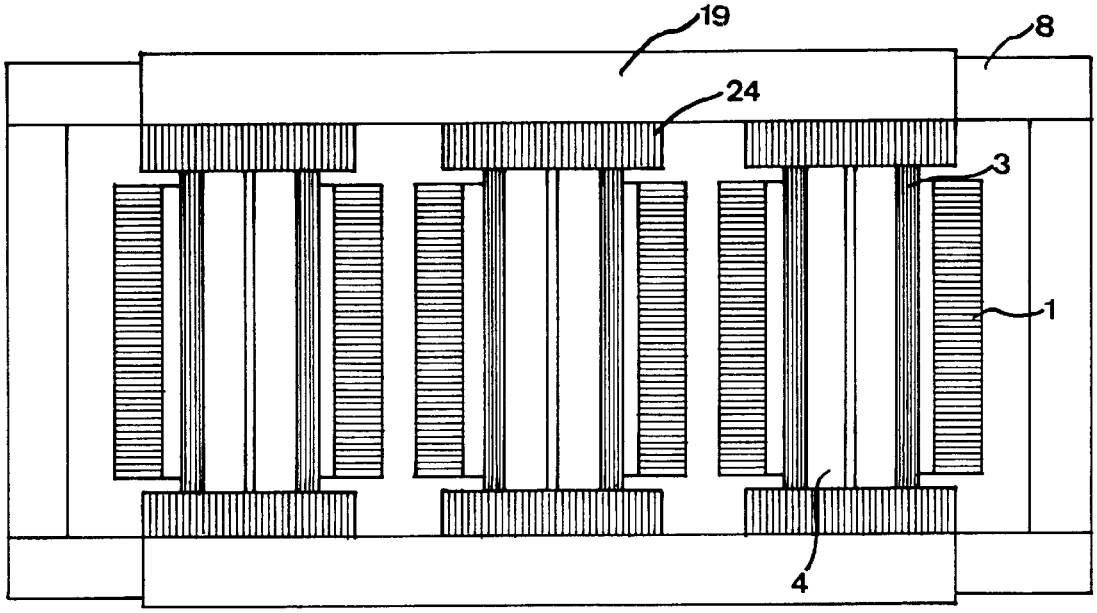
FIG. 8 is a view corresponding to FIG. 1 of an inductor adapted for connection to a three-phase alternating-current network according to a second preferred embodiment of the invention.
Figure 9:
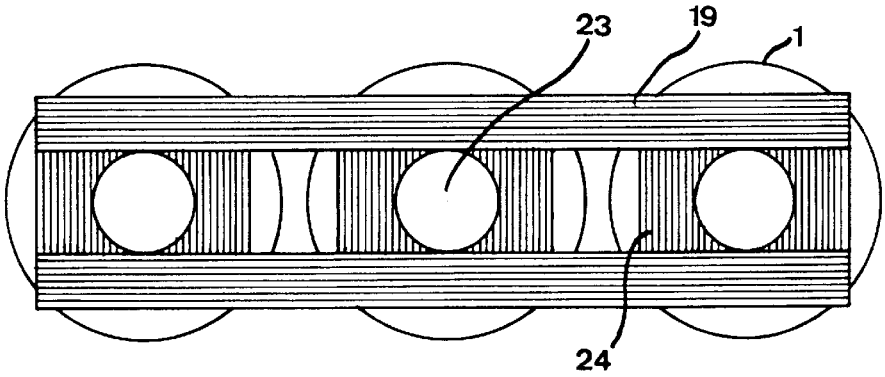
FIG. 9 is a view corresponding to FIG. 2 of an inductor according to FIG. 8, wherein, however, for illustrating purpose the control winding has been omitted.

An inductor according to another embodiment of the invention is illustrated in FIGS. 8 and 9, the construction of which corresponds to a large extent to that of the inductor according to FIGS. 1–7, so that here only the main differences therebetween will be explained. Corresponding parts of this inductor have been provided with the same reference numerals as for the inductor according to FIGS. 1–7. This inductor differs from that according to FIG. 1 by second plates 8, not shown in FIG. 9, run in the region directly above the inner hollow space 23 of the cores, while there are no longitudinal yoke plates, but such 19 are only located on both sides of the second control plates 8. This means that the longitudinal yoke plates will not cover the entire respective core end and the space between the main winding and the respective core for receiving the main magnetic flux coming from the respective core end, as a consequence of which transversal yoke plates 24 are arranged closer to the core than the longitudinal yoke plates 19 and are arranged to cover at least substantially the entire core at the respective end thereof for conducting the main magnetic flux from the core up to the longitudinal yoke plates 19. This inductor functions in essentially the same way as that according to the first embodiment, but a disadvantage of this with respect to the first embodiment is that the cross flux yoke plates 24 may cause a part of the control magnet flux to be led up thereinto, so that both longitudinal and cross magnetization of the yoke through the control current may occur. The yoke may by that be saturated with increased iron losses as a consequence.

Figure 10:
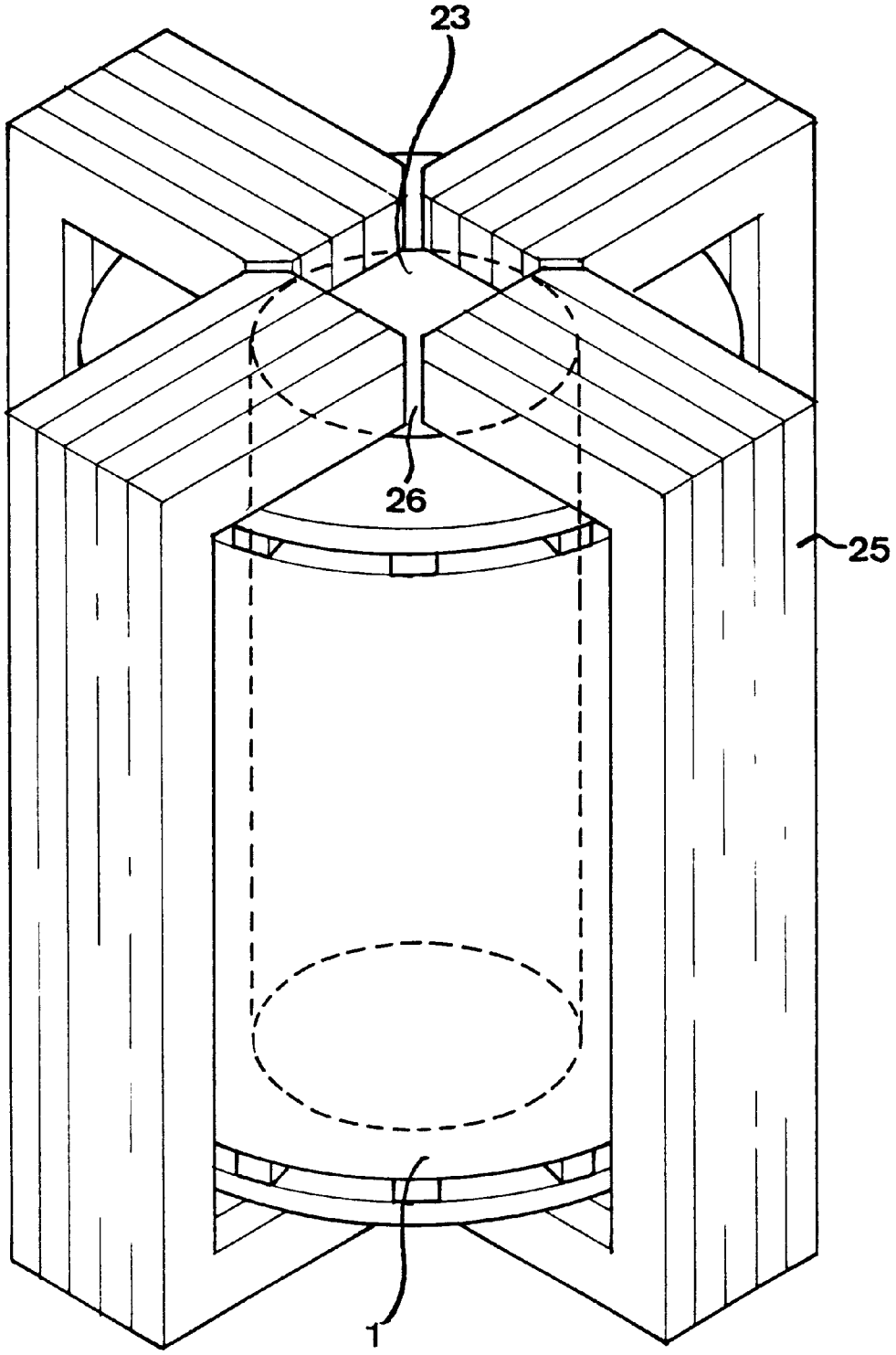
FIG. 10 is a simplified perspective view of an inductor according to a third preferred embodiment of the invention, which is adapted for connection to a one-phase alternating voltage, and a control winding has in this figure been omitted so as to better illustrate the construction of the inductor.

Furthermore, an inductor according to a third embodiment of the invention is illustrated in FIG. 10, which is intended to be connected to a one-phase voltage. This embodiment has four substantially U-shaped yoke pieces 25 arranged with a division of 90° and is arranged to close the main magnetic flux at the respective core end. These leave an opening for the inner hollow space 23 of the core therebetween for passing a control winding, not shown, therebetween. By arranging the yoke pieces 25 with air gaps 26 therebetween, the risk for an influence of the control current upon the permeability of the "iron" is reduced by the fact that control flux from the core goes up into the yoke pieces, which is advantageous.

Figure 11:
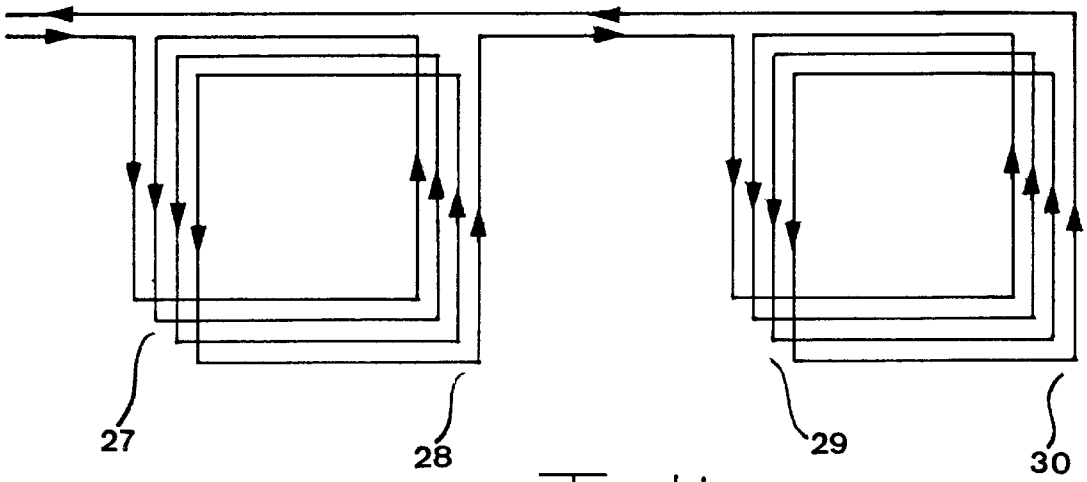
FIG. 11 is a view corresponding to FIG. 7 illustrating an alternative connection of control plates of the control winding to each other for obtaining the current path illustrated.
Figure 12:
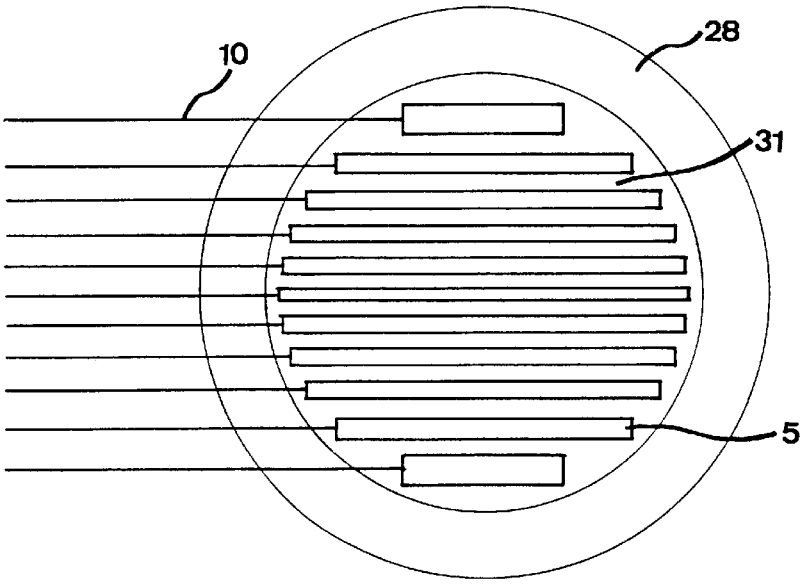
FIG. 12 illustrates schematically in a view from above how the control windings could run through one core in the control-plate connection according to FIG. 11.

It is illustrated in FIG. 11 that control winding alternatives other than that illustrated primarily in FIG. 7 are conceivable. Thus, the current runs all the turns through each core 28, 29, 30 on the way from one single outer leg 27 to the most remote third core 30 and the current is then running directly back to the connection to the voltage source in question at the outer leg 27. How the first core then may be realized is shown simplified in FIG. 12. No transverse space between control winding halves consisting of control plate packages is present here, but only longitudinal spaces 31 for receiving yoke plates between the control plate packages 5. The longitudinal control plate packages 10 are only shown through lines, but they have a similar construction as those illustrated in, for example FIG. 6.

The present invention is of course not in any way restricted to the preferred embodiments described above, but many possibilities to modifications thereof would be apparent to a person skilled in the art.

As an example of such modifications it may be mentioned that the mutual dimensioning of the different parts included in the inductor may be varied within a broad scope.

It may also be mentioned that the inductor may be manufactured for another number of phases than what has been shown in the figures.

What is claimed is:

1. A controllable inductor comprising at least a tubular core, a main winding wound substantially tangentially around said tubular core and a control winding passing axially through said tubular core, a yoke of a material having a high magnetic permeability, said yoke extending outside the core and the main winding and together with the core forming a closed loop having at most insignificant air gaps for a magnetic flux generated in the core by a current in said main winding, wherein the control winding comprises first plates extending axially through the core and being of a conducting material; wherein the control winding also comprises second plates (8) extending outside the core and the main winding and being of a material having a good electric conductivity, said plates being electrically connected to said first plates (6) and adapted together therewith form closed loops for a current flow in the first plates through the core; and further wherein a yoke comprises plates (18) being arranged to extend substantially in parallel with each other at each end of the core and being with their large surfaces thereof in parallel with a plane defined by a radius of the core (3) and the axis of the core, that said yoke plates have an edge (21) thereof located in the immediate vicinity of the respective core and so as to receive the main magnetic flux from the core without any substantial air gap therebetween, and that said second control plates (8) are arranged in a space between yoke plates arranged side by side and have substantially the same direction in the room as the yoke plates, so that the yoke plates and these control plates form a sandwich construction; and being connectable to a multiphase alternating-current network and it has one core (3) and one main winding (1) for connection to each phase.

2. An inductor according to claim 1, wherein said first and second plates are made of copper.

3. An inductor according to claim 1, wherein said first plates have large, flat surfaces which extend substantially in parallel with each other.

4. An inductor according to claim 1, wherein said first plates are formed into a plurality of plate packages, each said plate package being formed by a number of thin first plates pressed together with large flat surfaces thereof in mutual electrical contact.

5. An inductor according to claim 1, wherein the first plates are arranged in plate packages of first plates having large flat surfaces which are pressed against each other, said plate packages having one or more first plates, and said plate packages have substantially the same cross section.

6. An inductor according to claim 5, wherein the plate packages have a thickness decreasing in the direction of a radius of the core perpendicularly to the large flat surfaces of the first plates towards the center of the core for obtaining a maximum filling of the inner hollow space of the core.

7. An inductor according to claim 1, wherein said first and second plates of the control winding are of a material having a low magnetic permeability.

8. An inductor according to claim 1, wherein said yoke is arranged to cover at least substantially the entire cross section of the core and the space between the core and the main winding at each end of the core.

9. An inductor according to claim 4, wherein said second plates have large flat surfaces which are substantially in parallel with the large flat surfaces of the first plate, and that at least one first plate of each control plate package is arranged to protrude from the core past an edge of the respective second plate (8) located closest to the core so as to enter into electric contact establishing bearing thereagainst.

10. An inductor according to claim 1, wherein said second plates have an edge thereof located closest to the respective core end at a distance from this core end for allowing a passage of a cooling medium from the interior of the core and radially outwardly therefrom at said core end.

11. An inductor according to claim 1, wherein comprising three main windings for connection to a three-phase alternating-current network.

12. An inductor according to 1, further comprising a yoke being in common to and closing the main magnetic flux through all cores and forming main magnetic flux paths between all cores.

13. An inductor according to claim 1, wherein the cores are arranged adjacent to each other in a row, and that said first plates have large flat surfaces which are substantially in parallel with said row.

14. An inductor according to claim 1 wherein said yoke comprises a number of yoke plates arranged beside each other at each end of the core and extending substantially in parallel with each other, large surfaces of the yoke plates being substantially parallel with a plane defined by a radius of the core and an axis of the core, the yoke plates at each end of the core having an edge arranged immediately adjacent to the end to receive the main magnetic flux from the core, said second plates being arranged in a space between the yoke plates at each end of the core such that the yoke plates and the second plates form a sandwich construction.

15. An inductor according to claim 1 wherein said second control plates extend substantially in parallel with each other over an inner hollow space of said core; and said yoke comprises:

first portions arranged on both sides of said second plates and extending in the same direction as said second plates; and second portions extending transverse to said first portions and arranged closer to said core than said first portions, the second portions covering the core to lead the main magnetic flux from the core up to said first yoke portions.

16. An inductor according to claim 1 wherein the control winding of each core is electrically connected to a control winding of an adjacent core through said second plates, control windings of cores at ends of the row each being electrically connected through said second plates to a first and a second outer leg of third plates, respectively, said third plates connecting second plates at one end of said core to control plates at another end of said core.

17. An inductor according to claim 1 wherein said first plates are arranged in first and second groups which are separated from each other by a space extending transverse to large, flat surfaces of said first plates, said second plates being connected to first plates belonging to only one of said groups and extending in said core only to said space, said first, second and third plates forming a current path from said first outer leg through all said first plates in said first group in each core to said second outer leg and from said second outer leg through all said first plates in said second group back to said first outer leg.

* * * * *